US006270380B1

(12) United States Patent
Shichida et al.

(10) Patent No.: US 6,270,380 B1
(45) Date of Patent: Aug. 7, 2001

(54) MULTIPOLAR ELECTRICAL CONNECTOR

(75) Inventors: Akihito Shichida, Yao; Yutaka Uno, Nara, both of (JP)

(73) Assignee: Hosiden Corporation, Osaka-fu (JP)

( * ) Notice: Subject to any disclaimer, the term of this patent is extended or adjusted under 35 U.S.C. 154(b) by 0 days.

(21) Appl. No.: 09/629,948

(22) Filed: Aug. 1, 2000

(30) Foreign Application Priority Data

Feb. 14, 2000 (JP) ..... 12-034857

(51) Int. Cl.[7] ..... H01R 17/00
(52) U.S. Cl. ..... 439/669; 439/939; 200/51.1
(58) Field of Search ..... 439/188, 668, 439/669, 675, 939, 607, 852; 200/51.1

(56) References Cited

U.S. PATENT DOCUMENTS

| | | | | |
|---|---|---|---|---|
| 4,937,404 | * | 6/1990 | Kitagawa | 200/51.09 |
| 5,338,215 | * | 8/1994 | Lee et al. | 439/188 |
| 5,893,767 | * | 4/1999 | Brochard, III | 439/188 |
| 5,934,924 | * | 8/1999 | Suzuki | 439/318 |
| 6,000,970 | * | 12/1999 | Wu | 439/669 |
| 6,050,854 | * | 4/2000 | Fang et al. | 439/607 |
| 6,056,602 | * | 5/2000 | Wu | 439/668 |
| 6,077,126 | * | 6/2000 | Peng | 439/668 |
| 6,168,448 | * | 1/2001 | Chang | 439/188 |

FOREIGN PATENT DOCUMENTS

2112589 * 7/1983 (JP) .

* cited by examiner

*Primary Examiner*—Brian Sircus
*Assistant Examiner*—Thanh-Tam T Le
(74) *Attorney, Agent, or Firm*—Jones, Tullar & Cooper, P.C.

(57) ABSTRACT

The invention relates to a multipolar electrical connector, and more particularly to a multipolar electrical connector that, as a counter connector 90, uses a single-head plug having a pole shaft 91 in which center poles are disposed in plural positions in the axial direction, respectively (hereinafter, referred to merely as "multipolar connector"). In the invention, plural predetermined contact pieces are incorporated into the body 10, so that plural poles are ensured by the predetermined contact pieces. In the invention, a required number of first additional contact pieces 40 and second additional contact pieces 50 are placed on the outer and inner peripheral sides of the boss portion 30, so that two or more poles are ensured by the additional contact pieces 40 and 50. According to the invention, therefore, the number of poles is increased by that of poles which are formed by the additional contact pieces. Furthermore, the number of poles is increased by using the boss portion protruding from the body 10. Even when the number of poles is increased, therefore, the size of the whole of the multipolar connector is not increased in proportion to the increased number of poles.

11 Claims, 11 Drawing Sheets

21
44
16
43
15
10
11
40
42
35
53
31
52
A
50
13
37
33
32
58
34
30
36

76
67
65
62
90
66
19
72
71
18
14
63
64
61
75
44
10
60
76
91
17
56
15
59
73
41
74
82
81
70
57
80
24
83
40
A
36
42
96
51
54
37
51
30
31
96

76
72
59
10
A
90
54
95
51
30
31
96
42
40
82
44
62
67
91
63
92
60
93
73
94
70
83
80

MULTIPOLAR ELECTRICAL CONNECTOR

BACKGROUND OF THE INVENTION

1. Field of the Invention

The present invention relates to a multipolar electrical connector, and more particularly to a multipolar electrical connector that, as a counter connector, uses a single-head plug having a pole shaft in which center poles are disposed in plural positions in the axial direction, respectively (hereinafter, such a multipolar electrical connector is referred to merely as "multipolar connector"). The invention relates also to a multipolar connector wherein a boss portion protrudes from the body to which a predetermined contact piece is attached, and contact pieces of two or more poles can be added by using the boss portion. A multipolar connector of this kind can be preferably used in the field of a mobile communication apparatus such as a portable telephone, and that of an electric or electronic apparatus to which a portable cassette tape recorder, a radio receiver, and the like belong.

2. Description of the Prior Art

A single-head plug includes poles (the above-mentioned center poles) which are disposed in plural positions in the axial direction of a single pole shaft, respectively. A multipolar connector is structured so that the body has a space (insertion space) into which a pole shaft of such a single-head plug is to be inserted. A plurality of contact pieces are incorporated into the insertion space. Generally, such a multipolar connector is well known as a jack type multipolar connector. A multipolar connector of this kind has been developed so as to be used in a portable telephone, a portable cassette tape recorder, a portable radio receiver, and the like. In order to correspond to the recent tendency to miniaturization of an apparatus, such a multipolar connector is requested to be microminiaturized. Furthermore, in order to cope with increased functions of an apparatus, a multipolar connector is requested to have a larger number of poles.

SUMMARY OF THE INVENTION

The present invention has been conducted in view of the above-mentioned circumstances.

It is an object of the invention to increase the number of poles by disposing contact pieces by using a boss portion which protrudes from the front face of the body.

It is another object of the invention to enable the number of poles of a multipolar connector to be increased while preventing the size of the multipolar connector as far as possible from being increased.

Referring to the drawings, the multipolar connector of the invention will be described. The reference numerals in the figures are used in this paragraph in order to facilitate the understanding of the invention, and the use of the reference numerals is not intended to restrict the contents of the invention to the illustrated embodiment.

In the multipolar connector of the invention, a single-head plug including: a pole shaft 91 in which center poles 92 to 95 are disposed in plural positions in an axial direction; and at least one peripheral pole 96 which is opposed to an outside of a root of the pole shaft 91 with being separated from the root of the pole shaft 91 by a distance is used as a counter connector 90.

The multipolar connector of the invention has: a body 10 comprising an insertion space 14 for the pole shaft 91; a plurality of predetermined contact pieces 60, 70, and 80 attached to the body 10 and comprising predetermined contacts 63, 73, and 83 which are to be in contact with the center poles 92 to 94 other than the center pole in the root of the pole shaft 91 that is inserted into the insertion space 14, respectively; and a cylindrical boss portion 30 which protrudes from a front end of the body 10, and which forms an insertion/extraction port 37 communicating with the insertion space 14.

In the multipolar connector of the invention, therefore, a given number of poles, for example, three poles or first to third poles are ensured by the predetermined contact pieces 60, 70, and 80, and a larger number of poles are ensured by additional contact pieces which are placed on outer and inner peripheral sides of the boss portion 30. Furthermore, one or plural poles are ensured by an additional contact piece(s) which is placed on the outer peripheral side of the boss portion 30, and one or plural poles are ensured by an additional contact piece(s) which is placed on the inner peripheral side of the boss portion 30.

The multipolar connector of the invention has: a plate-like first additional contact piece 40 which is placed in a placement position for the first additional contact piece 40, the placement position being formed in at least one position of the outer peripheral side of the boss portion 30; a first additional contact 42 which is disposed on the first additional contact piece 40, and which is to be in contact with the peripheral pole 96 disposed in the counter connector 90; a second additional contact piece 50 which is placed in a placement position for the second additional contact piece 50, the placement position being formed in at least one position of the inner peripheral side of the boss portion 30; and a second additional contact 58 which is disposed on the second additional contact piece 50, and which is to be in contact with the center pole 95 in the root of the pole shaft 91 of the counter connector 90.

According to the invention, therefore, the poles the number of which is equal to a sum of the number of the first additional contact piece(s) 40, and that of the second additional contact piece(s) 50 are added to the poles which are ensured by the predetermined contact pieces 60, 70, and 80. Since the first additional contact piece 40 which is disposed by using the boss portion 30 has a plate-like shape, miniaturization can be attained more easily as compared with the case where the first additional contact piece 40 is formed into a ring-like or cylinder-like shape. Particularly, the first additional contact piece 40 can be formed at least one of the right and left sides of the boss portion 30. According to this configuration, the first additional contact piece 40 and the first additional contact 42 do not protrude into the spaces above and below the upper and lower faces of the body 10, and hence increase of the size due to an increased height does not occur in the multipolar connector.

Preferably, the boss portion 30 is formed into a cylindrical shape having a flat circle-cutaway portion 31 which is formed by cutting away a part of an outer side of a peripheral wall of the boss portion, and the circle-cutaway portion 31 functions as the placement position for the first additional contact piece 40. According to this configuration, the placement position for the first additional contact piece 40 can be made closer to the center of the boss portion 30, and this is useful to suppress increase of the size of the multipolar connector.

Preferably, the first additional contact piece 40 has a first mounting plate portion 41 which is fixed to the body 10, and forward elongates from the first mounting plate portion 41 along an outer face of the circle-cutaway portion 31 of the boss portion 30, to form a gap between the piece and the outer face of the circle-cutaway portion 31. According to this configuration, even when the multipolar connector is miniaturized, the first additional contact piece 40 can be easily incorporated through the first mounting plate portion 41. When a configuration in which the first mounting plate portion 41 is fixed to the body 10 under a state where the portion is inserted into a mounting groove 15 that rearward elongates from a front end face of the body 10 is employed, particularly, the attachment of the first mounting plate portion 41 of the first additional contact piece 40 can be performed by inserting the portion into the mounting groove 15 from the front side of the body 10.

Preferably, the first additional contact 42 outward protrudes from an inner side of a circle-cutaway space which is formed by the circle-cutaway portion 31 of the boss portion 30. According to this configuration, in order to cause the first additional contact 42 to be surely in contact with the peripheral pole 96 of the counter connector, it is requested only to insert the pole shaft 91 of the counter connector into the insertion space 14 of the body 10. Therefore, the stability of the contact between the first additional contact 42 and the peripheral pole 96 of the counter connector is improved. The circle-cutaway space is a space which, assuming that an outer peripheral face of the boss portion 30 has a completely circular face, is inevitably formed between the circular face and the circle-cutaway portion 31 by forming the circle-cutaway portion 31.

In the invention, preferably, a cutaway portion 34 in which a narrow portion 32 is located on a side of the front end of the boss portion 30 and a wide portion 33 continuous to the narrow portion 32 is located on a side of a rear end of the boss portion 30 is disposed in a position in a circumferential direction of the peripheral wall of the boss portion 30, the second additional contact piece 50 which is formed into an annular shape is placed in the placement position for the second additional contact piece 50 that is annularly formed on the inner periphery side of the boss portion 30, a gap is ensured between the second additional contact piece 50 and the inner peripheral face of the boss portion 30, the second additional contact piece 50 is split in a position in a circumferential direction of an annular portion 51 and has a pair of outward tongue pieces 52 and 53 which are disposed in end portions that are opposed to each other in the split portion, respectively, and the outward tongue pieces 52 and 53 are inserted into the wide portion 33 of the cutaway portion 34, and displaceable in the wide portion 33 in separating and approaching directions in accordance with expanding and contracting deformations of the annular portion 51. When the annular portion 51 is pressingly expanded by the pole shaft 91 of the counter connector inserted into the annular portion 51, preferably, the pair of outward tongue pieces 52 and 53 are displaced in the separating directions, whereby the pieces are respectively opposed in an axial direction of the boss portion 30 to step portions 35 in a boundary area between the narrow portion 32 and the wide portion 33 of the cutaway portion 34.

According to the invention, when the pole shaft 91 of the counter connector is inserted into the annular portion 51 of the second additional contact piece 50, the pair of outward tongue pieces 52 and 53 of the annular portion 51 of the second additional contact piece 50 are displaced in the separating directions in the wide portion 33 of the cutaway portion 34 on the side of the boss portion 30, to enter the state where the pieces are opposed to the step portions 35 in the axial direction of the boss portion 30. When the counter connector is pulled out, therefore, the outward tongue pieces 52 and 53 are engaged with the step portions 35 to prevent the second additional contact piece 50 from being pulled out together with the counter connector.

The multipolar connector of the invention may have a configuration in which five poles are formed by the three predetermined contact pieces 60, 70, and 80, the one first additional contact piece 40, and the one second additional contact piece 50. According to this configuration, it is possible to configure a multipolar connector having five poles. In this case, a configuration may be employed in which, among the three predetermined contact pieces 60, 70, and 80, the two predetermined contact pieces 60 and 70 are respectively placed on right and left sides of the insertion space, and the remaining one or the predetermined contact piece 80 is placed in front of one of the two predetermined contact pieces 60 and 70, or the predetermined contact piece 60. In this case, the three predetermined contact pieces 60, 70, and 80 can be easily attached to the body 10, and this is useful to suppress increase of the size of the body 10. This function is remarkably exerted when a configuration is employed in which the remaining one predetermined contact piece 80 is formed into a folded shape with respect to a mounting plate portion 81 that is disposed continuously from the predetermined contact piece 80, and the predetermined contact piece 80 and the mounting plate portion 81 are placed in a mounting groove 25 that is passed through the body 10 in a thickness direction.

As described above, according to the invention, the first and second additional contact pieces which can be used for increasing the number of poles are placed on the outer and inner peripheral sides of the boss portion, and hence the number of poles of the multipolar connector can be increased without thickening the connector. Since the first additional contact piece is formed into a plate-like shape, furthermore, there is an advantage that the first additional contact piece itself can be extremely miniaturized as compared with a contact piece of the prior art which has a ring-like or cylinder-like shape, and this is remarkably useful for miniaturizing the multipolar connector. In the configuration where the first additional contact piece is placed by using the circle-cutaway portion formed on the boss portion, the boss portion can be miniaturized and an excessive space due to the miniaturization of the boss portion is used as a space for placing the first additional contact piece, thereby producing an advantage that, although the number of poles is increased as a result of using the first additional contact piece, the size of the whole of the multipolar connector is not increased.

DETAILED DESCRIPTION OF THE PREFERRED EMBODIMENT

Hereinafter, an embodiment of the invention will be described.

Figure 1:
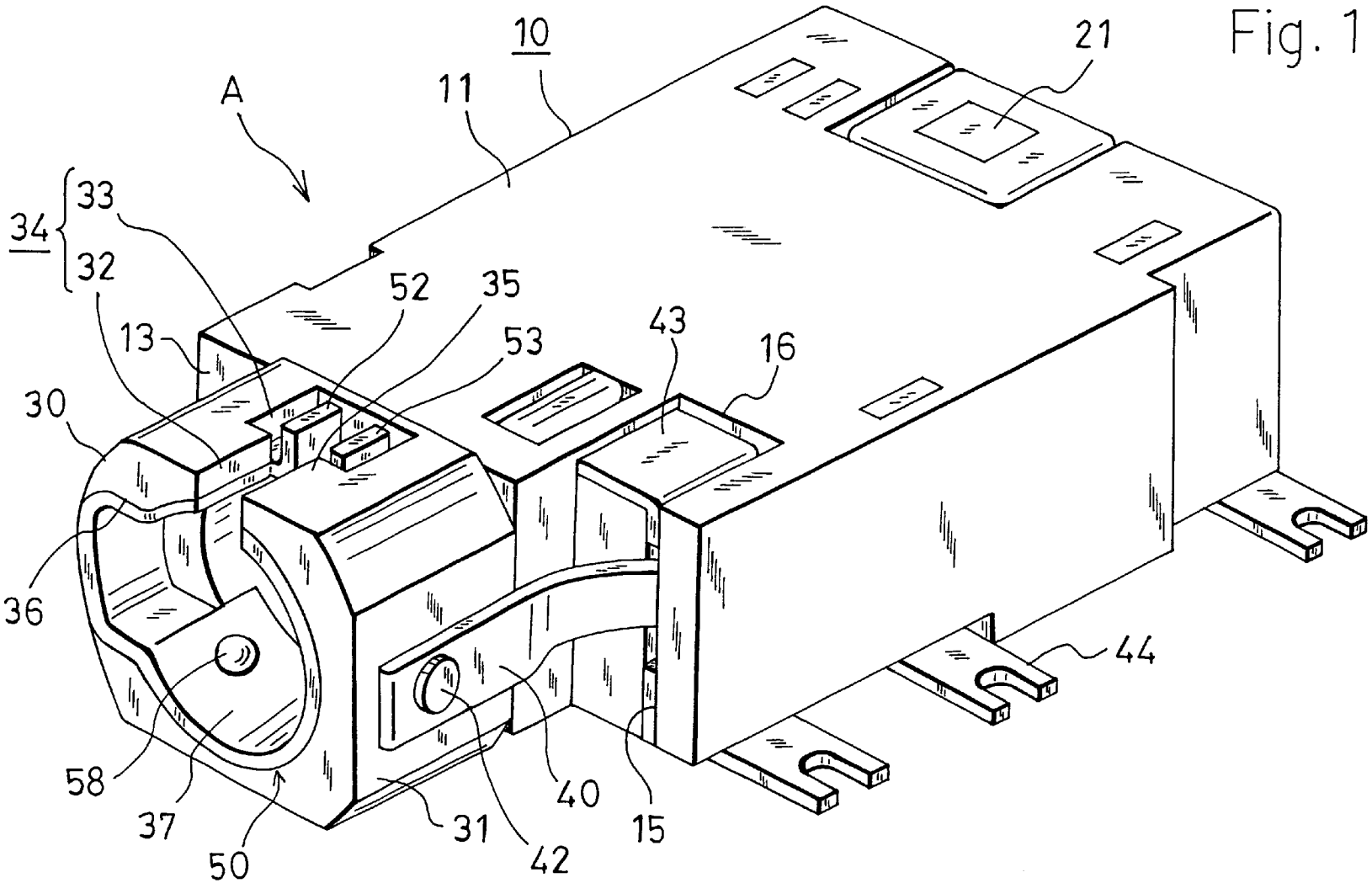
FIG. 1 is a schematic perspective view of the multipolar connector of the invention as seeing obliquely from the front side.

As shown in FIG. 1, the body 10 of a multipolar connector A is formed into a rectangular parallelepiped of a low profile. The upper face 11 and the lower face 12 (see FIG. 9 or 10) of the body 10 are flat. The front face 13 of the body 10 is configured as a laterally prolonged flat face. A boss portion 30 which is integrated with the body 10 and made of a synthetic resin protrudes forward from a center portion of the front face 13.

The boss portion 30 is formed into a cylindrical shape having a circle-cutaway portion 31 which is formed to be flat by cutting away a part of the outer side of the peripheral wall. The circle-cutaway portion 31 functions as a placement position for a first additional contact piece 40. In the illustrated multipolar connector A, the diameter of the cylindrical boss portion 30 is larger than the distance (the height of the body 10) between the upper face 11 and the lower face 12 of the body 10, and upper and lower portions of the boss portion 30 are partly cut away so as to be flat, with the result that the portions are substantially flush with the upper face 11 and the lower face 12 of the body 10, respectively. Alternatively, upper and lower portions of the boss portion may be formed into an arcuate shape, and the arcuate portions may protrude from the upper and lower faces of the body 10, respectively.

Figure 9:
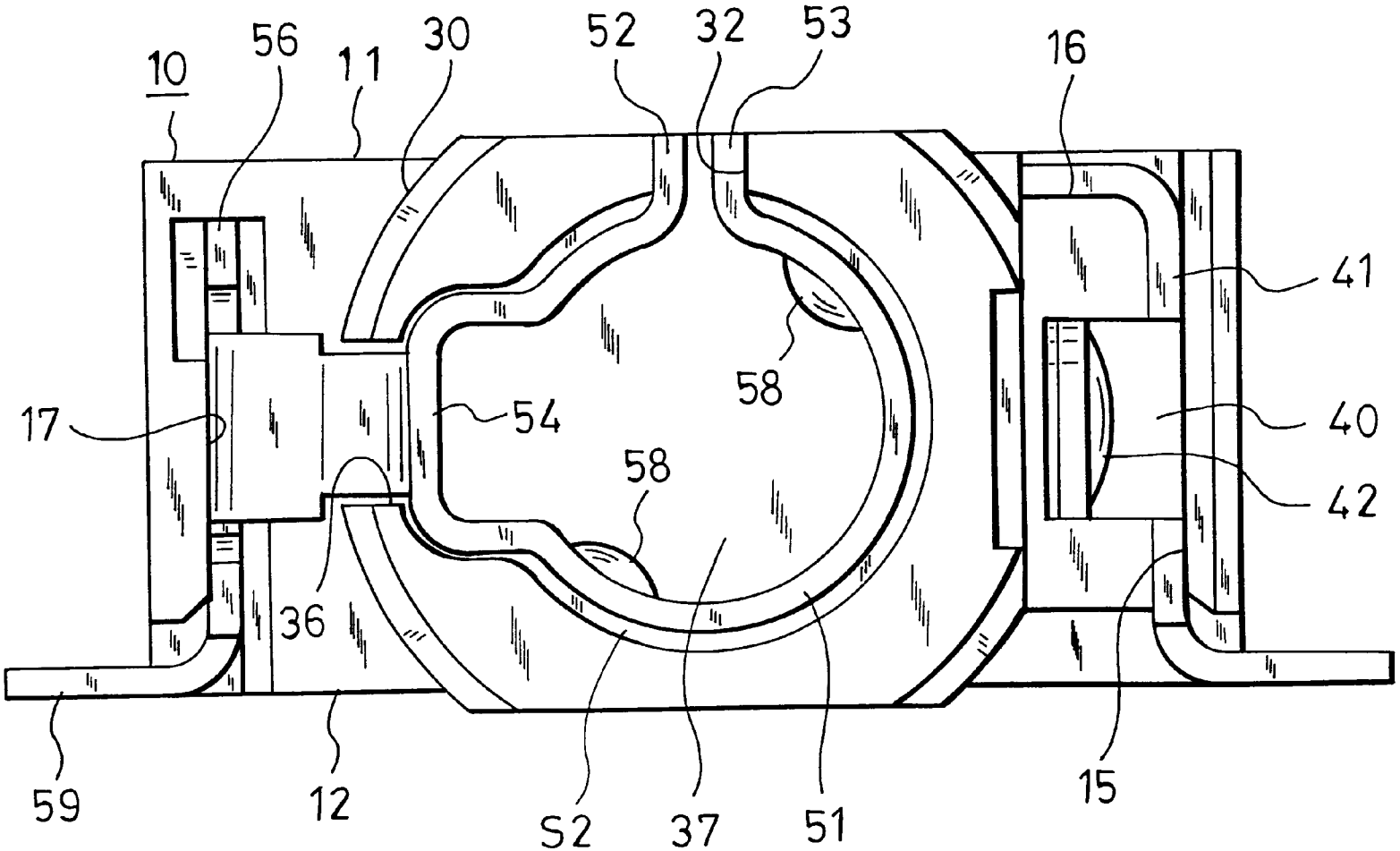
FIG. 9 is a schematic front view of a multipolar connector.

As shown in FIG. 1 or 9, a cutaway portion 34 is formed in a position (in the embodiment, an apex portion) in the circumferential direction of the boss portion 30. In the cutaway portion 34, a narrow portion 32 is located on the side of the front end of the boss portion 30, and a wide portion 33 continuous to the narrow portion 32 is located on the side of the rear end of the boss portion 30. In the cutaway portion 34, step portions 35 are disposed in a boundary area between the narrow portion 32 and the wide portion 33. A notched hole 36 which elongates over the whole length of the boss portion 30 is opened in the left side of the boss portion 30.

Figure 8:
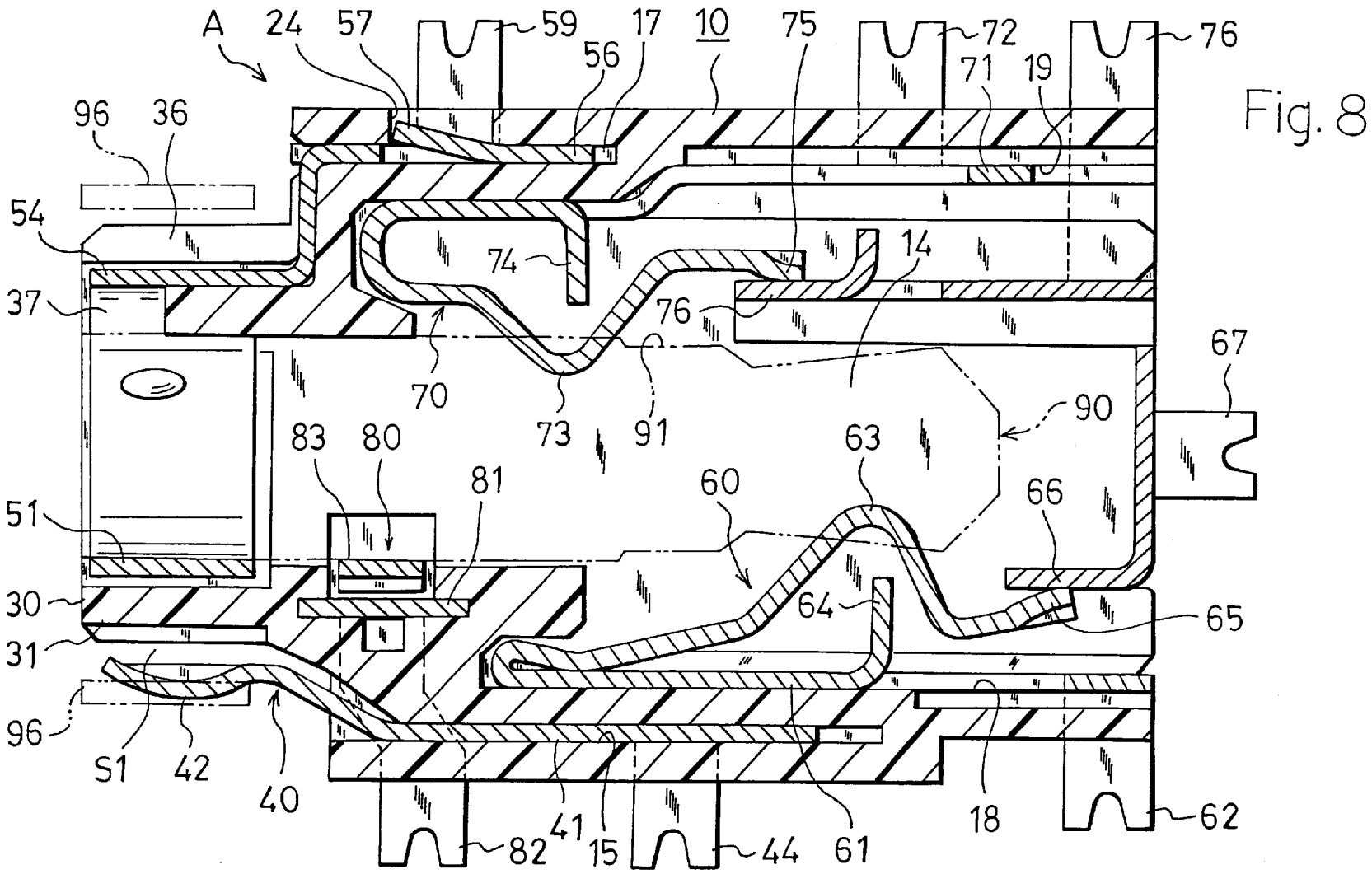
FIG. 8 is a schematic horizontal section view of the multipolar connector shown in FIG. 1.

As shown in FIG. 8, an insertion space 14 into which a pole shaft 91 of a counter connector 90 (described later) is to be inserted is formed in the body 10, and an insertion/extraction port 37 which communicates with the insertion space 14 is formed in the boss portion 30. The insertion space 14 is opened in the rear end of the body 10.

Figure 10:
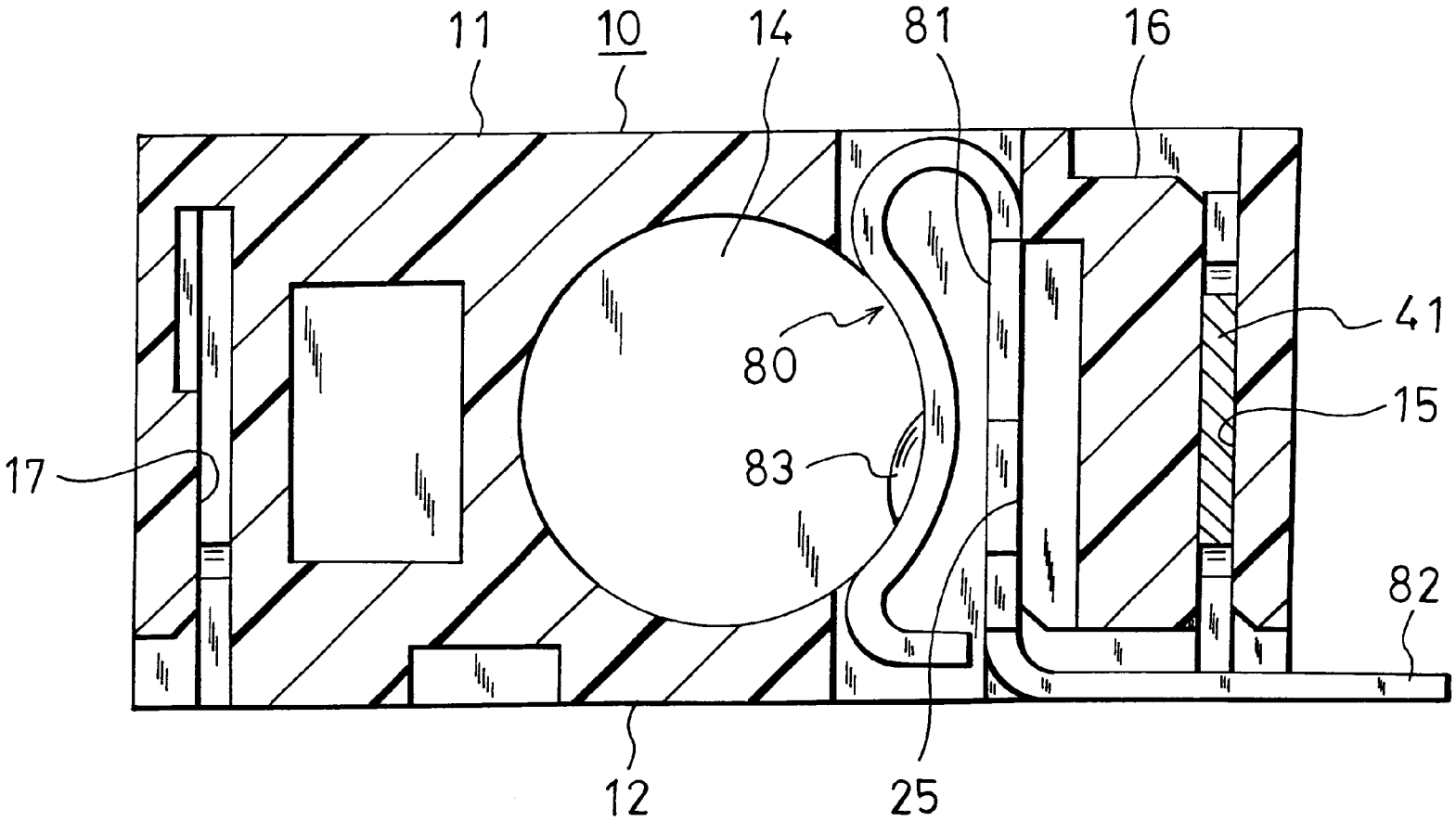
FIG. 10 is a schematic section view showing the case where a multipolar connector is perpendicularly cut in the vicinity of the front end of the body.

As shown in FIGS. 1, 9, and 10, a mounting groove 15 which elongates in the thickness direction of the body 10 is formed in the right front side of the body 10, and a recess 16 which communicates with the mounting groove 15 is formed in the upper face 11 of the body 10. As shown in FIG. 9 or 10, a mounting groove 17 which is opened in the lower face of the body 10 and which upward elongates is formed in the left side in the vicinity of the front end of the body. As shown in FIG. 8, mounting grooves 18 and 19 which are opened in the rear end are formed in the left and right sides that are on both sides of the insertion space 14, respectively. An engaging projection 21 (see FIG. 1) is formed in a position in the vicinity of the rear end of the upper face 11 of the body 10. A similar engaging projection (not shown) is formed also in the lower face 12 of the body 10.

Figure 2:
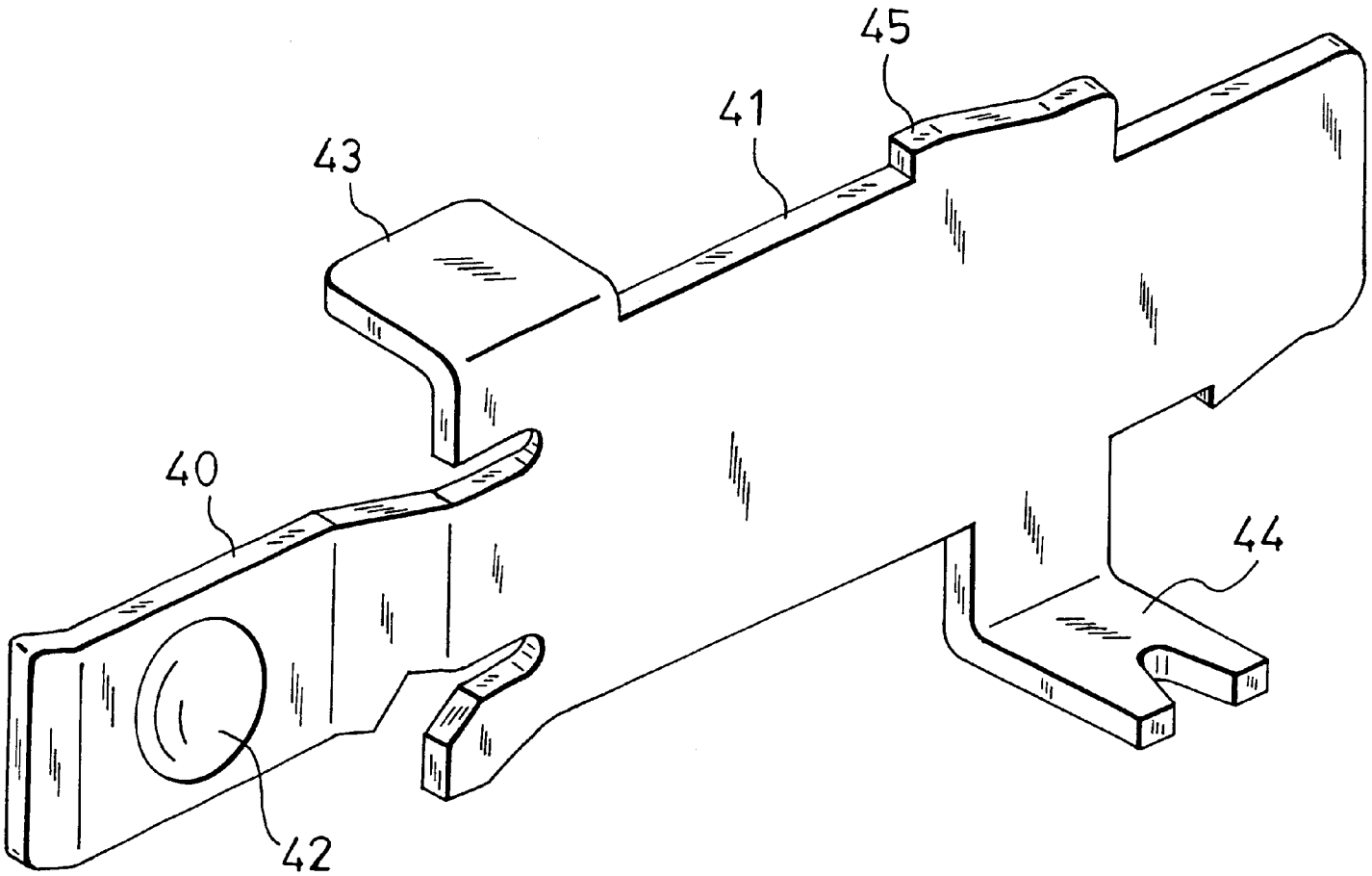
FIG. 2 is a schematic perspective view showing a first additional contact piece and a first mounting plate portion.

As shown in FIG. 2, the first additional contact piece 40 is formed into a long and narrow plate piece-like shape. A spherical first additional contact 42 which outward protrudes is formed in a tip end portion of the first additional contact piece 40. A first mounting plate portion 41 which has a plate piece-like shape is formed so as to be continuous to the first additional contact piece 40. In the first mounting plate portion 41, an engaging piece 43 is bendingly formed in the upper edge, and a soldering terminal 44 is bendingly formed in the lower edge. As known from FIG. 1 or 8, the first additional contact piece 40 is fixed to the mounting groove 15 which is formed in the right side of the body 10, by inserting the first mounting plate portion 41 into the mounting groove 15 from the front side. In this case, an engaging claw 45 (see FIG. 2) formed on the first mounting plate portion 41 is engaged with a wall of the mounting groove 15, thereby preventing the first mounting plate portion from slipping off from the mounting groove 15. Under this mounting state, as shown in FIG. 1 or 8, the first additional contact piece 40 forward elongates along a flat outer face of the circle-cutaway portion 31 of the boss portion 30, and a gap S1 is formed between the piece and the flat outer face of the circle-cutaway portion 31. The first additional contact 42 outward protrudes from the inner side of the circle-cutaway space which is formed by the circle-cutaway portion 31 of the boss portion 30. The gap S1 is useful for absorbing an inward displacement of the first additional contact piece 40. As shown in FIG. 1 or 8, the soldering terminal 44 disposed on the first mounting plate portion 41 laterally protrudes from the lower side of the body 10.

When the first additional contact piece 40 is placed so as to forward elongate along the flat outer face of the circle-cutaway portion 31 of the boss portion 30 as described above, the first additional contact piece 40 can be placed so as to be close to the center of the boss portion 30.

Referring to FIG. 1, 50 denotes a second additional contact piece. As shown in FIGS. 6, 7A, 7B, and 7C, the second additional contact piece 50 has an annular portion 51. The inner diameter of the annular portion 51 in a natural state is slightly smaller than the outer diameter of the root of the pole shaft 91 of the counter connector 90 shown in FIG. 11. In the annular portion 51, a position in the circumferential direction is split, and outward tongue pieces 52 and 53 are disposed in a bent state integrally with a pair of end portions that are opposed to each other in the split portion, respectively. In a stage before the second additional contact piece 50 is placed in the boss portion 30, the pair of outward tongue pieces 52 and 53 are opposed to each other with being separated by a distance which allows the tongue pieces to be inserted into the narrow portion 32 of the cutaway portion 34, even when the tongue pieces are not to be displaced in an approaching direction. A bulge portion 54 is formed in the left side of the annular portion 51. A plate piece portion 55 outward protrudes from the rear end of the bulge portion 54. A mounting plate portion 56 rearward elongates from the outer end of the plate piece portion 55. An engaging claw 57 is disposed on the mounting plate portion 56. The reference numeral 58 denotes a second additional contact which is disposed in each of two positions of the annular portion 51, and 59 denotes a soldering terminal which is disposed continuously from the mounting plate portion 56.

The second additional contact piece 50 is fitted into the inner peripheral side of the boss portion 30 from the front side. Specifically, as shown in FIG. 8, the mounting plate portion 56 is inserted into the mounting groove 17 which is formed in the body 10, the bulge portion 54 of the annular portion 51 is slightly fitted into the notched hole 36 of the boss portion 30, and the pair of outward tongue pieces 52 and 53 are slightly fitted into the narrow portion 32 of the cutaway portion 34 of the boss portion 30. Under this state, the second additional contact piece 50 is rearward pushed to cause the annular portion 51 to be fitted into the boss portion 30. As a result, the bulge portion 54 is completely fitted into the notched hole 36, and the pair of outward tongue pieces 52 and 53 are completely fitted into the wide portion 33 of the cutaway portion 34. Furthermore, the mounting plate portion 56 is pressed into the mounting groove 17, and the engaging claw 57 is engaged with an engaging recess 24 of the body 10. Therefore, the second additional contact piece 50 in which the annular portion 51 is fittingly placed on the inner peripheral side of the boss portion 30 is prevented from slipping off from the boss portion 30, by the engagement of the engaging claw 57 and the engaging recess 24. Under this mounting state, a gap S2 shown in FIG. 9 is ensured between the annular portion 51 and the inner peripheral face of the boss portion 30. The gap S2 enables the diameter of the annular portion 51 to be increased. As shown in FIG. 8 or 9, the soldering terminal 59 laterally protrudes from the lower side of the body 10.

Figure 11:
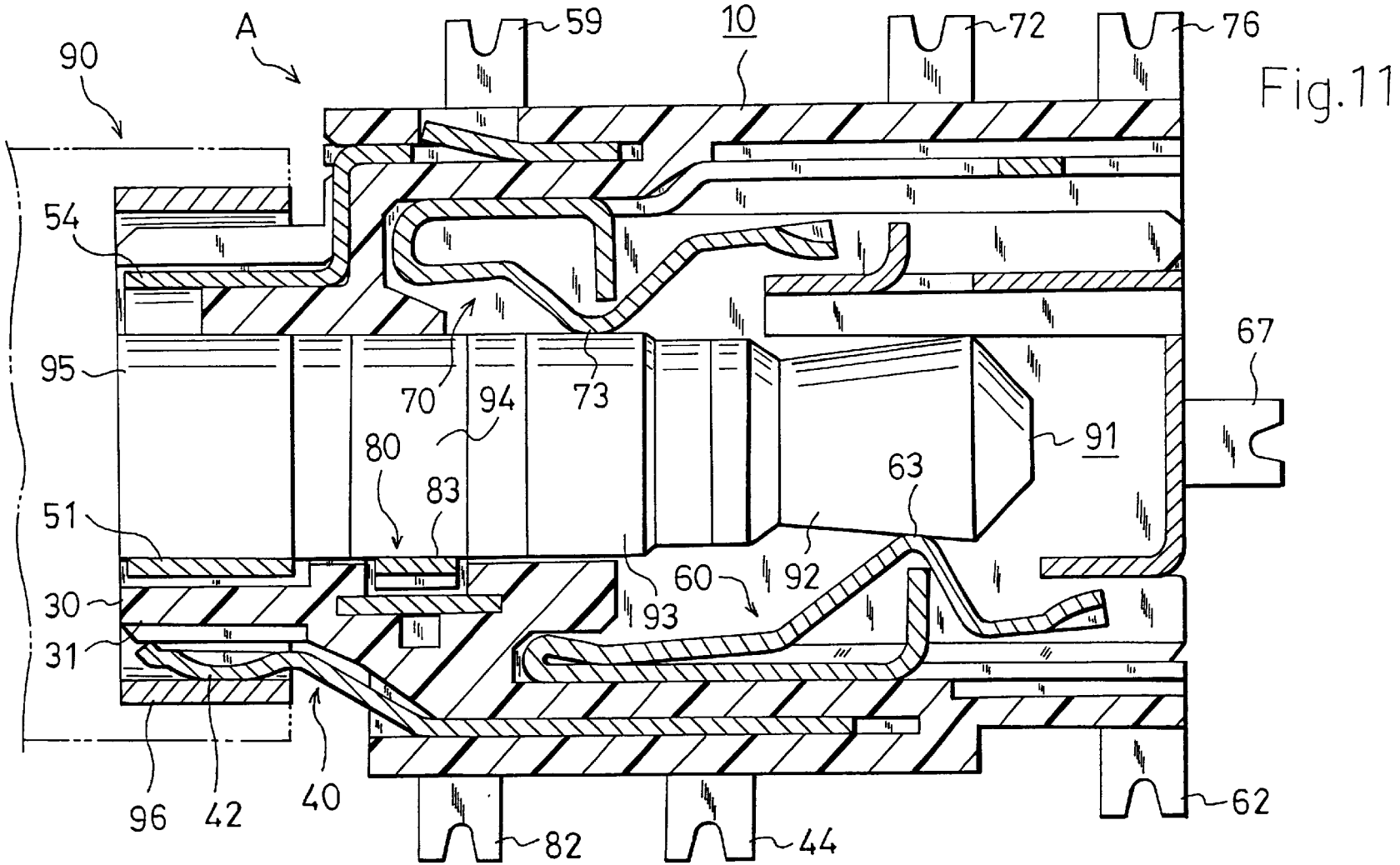
FIG. 11 is a schematic section view corresponding to FIG. 10 and showing a state where a pole shaft of a counter connector is inserted into an insertion space.

Under a state where the second additional contact piece 50 is incorporated into the boss portion 30 as described above, as shown in FIG. 1, the pair of outward tongue pieces 52 and 53 are separated from the wall faces of the wide portion 33 of the cutaway portion 34, and opposed to the narrow portion 32. When the pole shaft 91 of the counter connector 90 is inserted into the annular portion 51 under this state as shown in FIG. 11, the annular portion 51 is pressingly expanded by the pole shaft 91. In accordance with the expansion, the pair of outward tongue pieces 52 and 53 shown in FIG. 1 are displaced in the separating directions in the wide portion 33 of the cutaway portion 34, and the pieces are opposed in the axial direction of the boss portion 30 to the step portions 35 in the boundary area between the narrow portion 32 and the wide portion 33. When the pole shaft 91 of the counter connector 90 is pulled out, therefore, the outward tongue pieces 52 and 53 are engaged with the step portions 35 to prevent the second additional contact piece from being pulled out together with the counter connector.

When the counter connector 90 is repeatedly inserted and extracted, the annular portion 51 of the second additional contact piece 50 is plastically deformed to slightly increase its diameter. Such plastic deformation causes the pair of outward tongue pieces 52 and 53 to be always opposed to the step portions 35.

As shown in FIG. 8, the three predetermined contact pieces 60, 70, and 80 are placed so as to face the insertion space 14 formed in the body 10. Among the predetermined contact pieces, the two predetermined contact pieces 60 and 70 are respectively placed on the right and left sides of the insertion space 14, and the remaining one or the predetermined contact piece 80 is placed in front of the predetermined contact piece 60.

Figure 3:
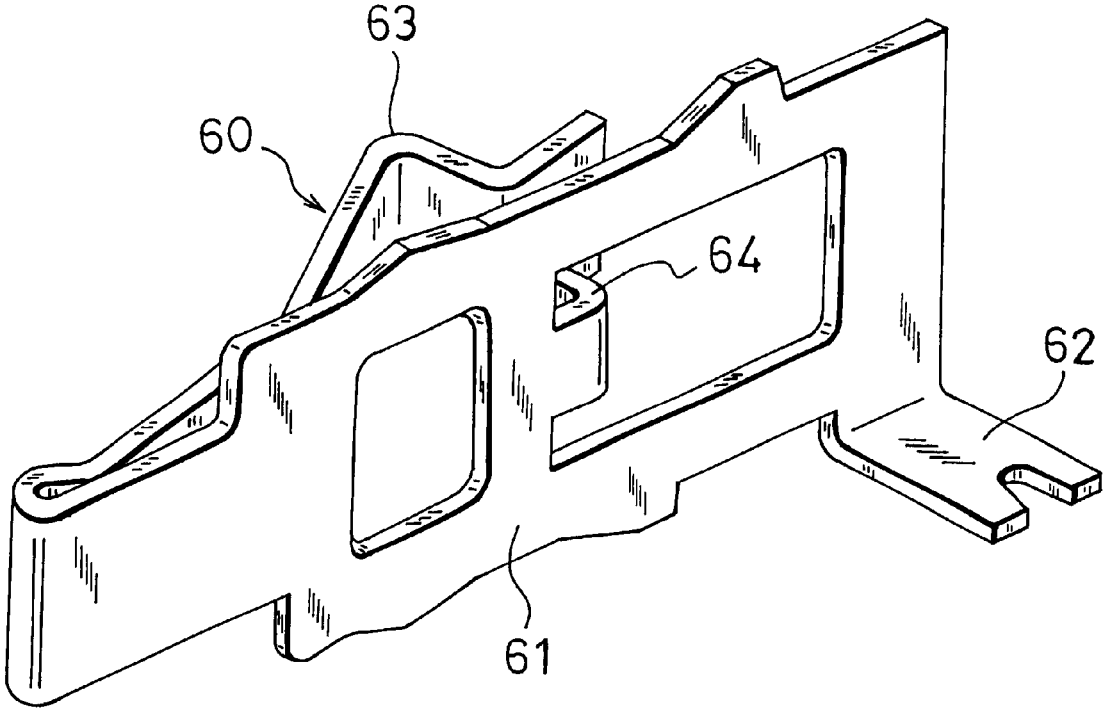
FIG. 3 is a schematic perspective view of a predetermined contact piece.
Figure 4A:
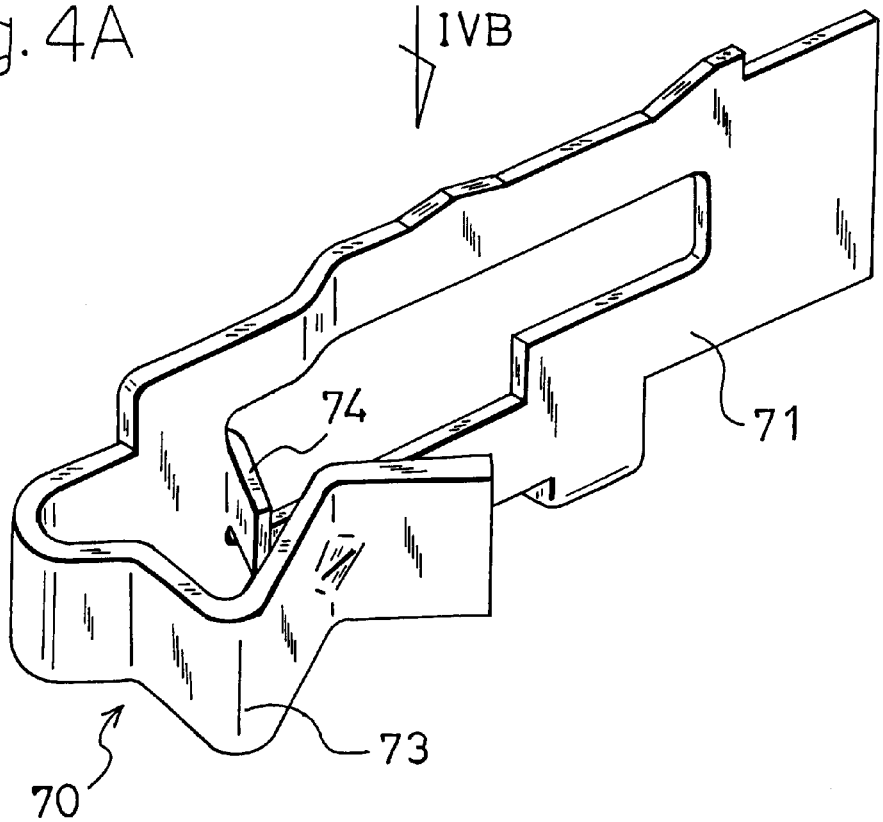
FIG. 4A is a schematic perspective view of another predetermined contact piece.
Figure 4B:
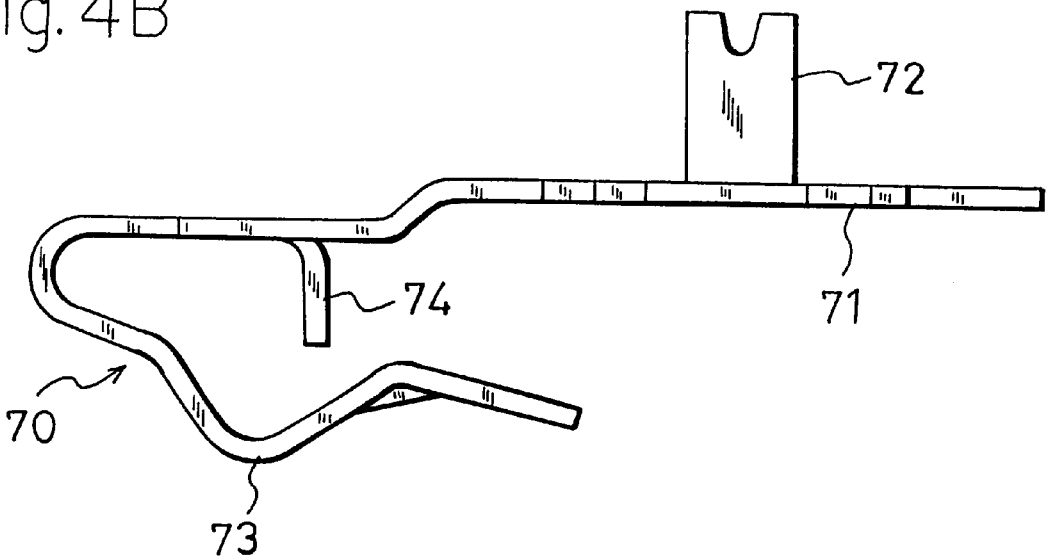
FIG. 4B is a view as seeing in the direction of an arrow IVB of FIG. 4A.
Figure 5:
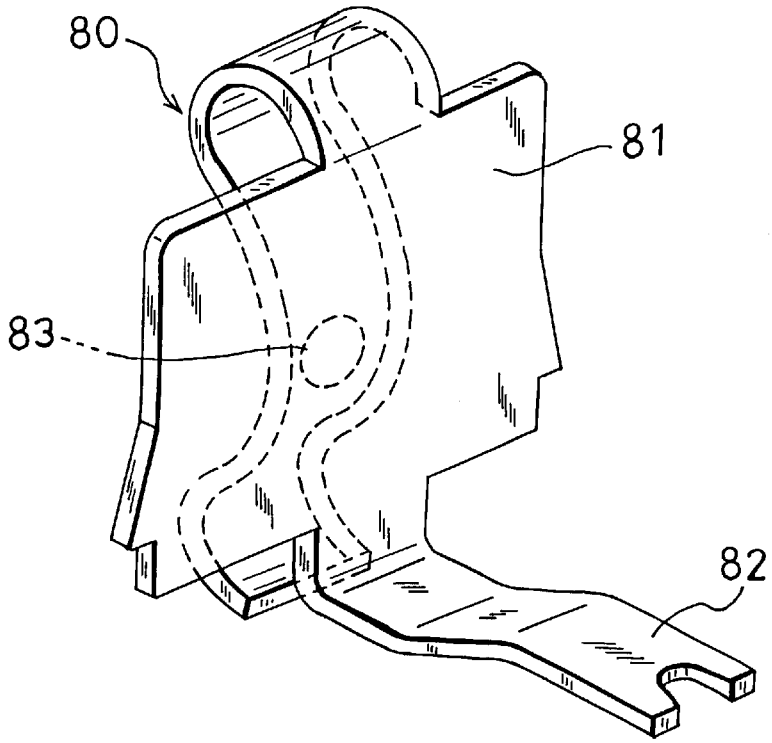
FIG. 5 is a schematic perspective view of a further predetermined contact piece.
Figure 6:
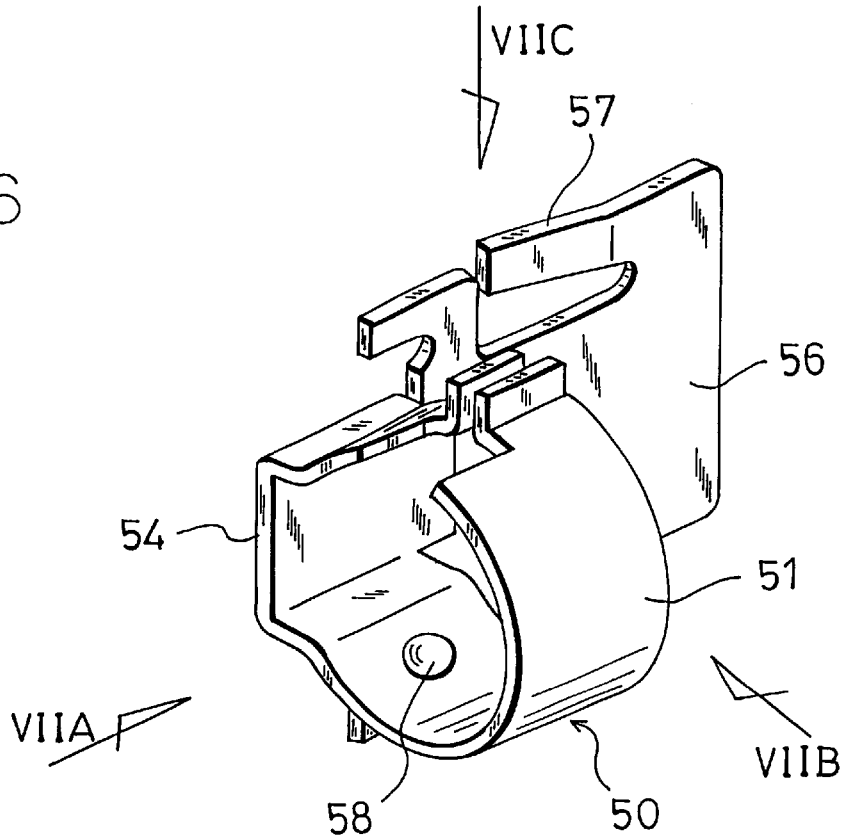
FIG. 6 is a schematic perspective view of a second additional contact piece.
Figure 7A:
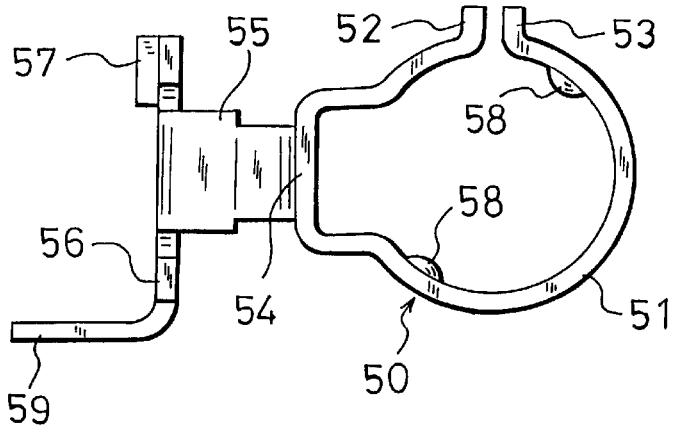
FIG. 7A is a view as seeing in the direction of an arrow VIIA of FIG. 6.
Figure 7B:
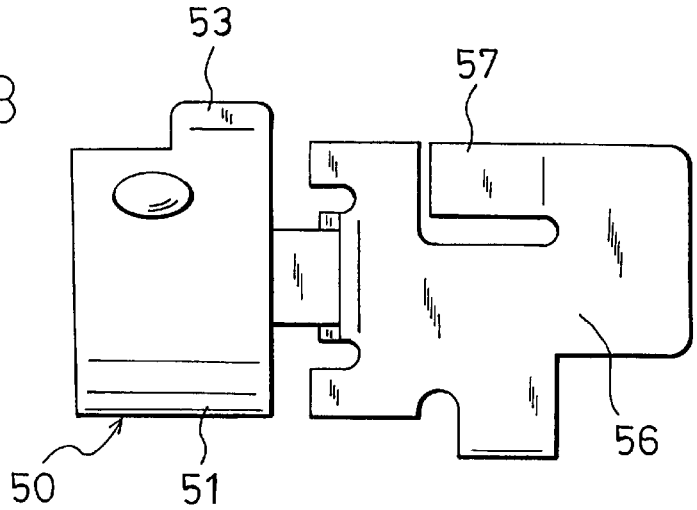
FIG. 7B is a view as seeing in the direction of an arrow VIIB of FIG. 6.
Figure 7C:
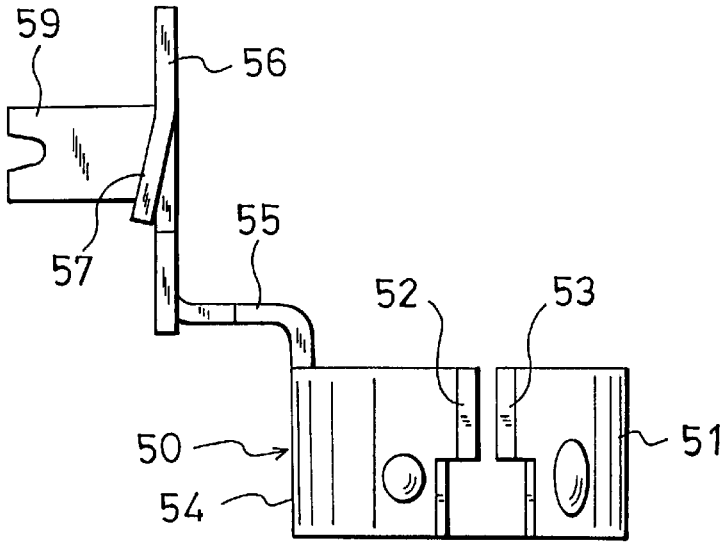
FIG. 7C is a view as seeing in the direction of an arrow VIIC of FIG. 6.

The predetermined contact pieces 60, 70, and 80 are shown in FIGS. 3 to 5, respectively.

In the predetermined contact piece 60 shown in FIG. 3, the front end portion is formed into a folded shape with respect to a mounting plate portion 61. A predetermined contact 63 is disposed on the predetermined contact piece 60, and a soldering terminal 62 is disposed continuously from the mounting plate portion 61. A projecting piece 64 which is bendingly formed on the mounting plate portion 61 can prevent the predetermined contact piece 60 from being broken by excessive deformation. The predetermined contact piece 60 is attached to the body 10 by inserting the mounting plate portion 61 into the mounting groove 18 of the body 10 from the rear side. Under this mounting state, as shown in FIG. 8, the predetermined contact 63 of the predetermined contact piece 60 protrudes into the insertion space 14. In the illustrated multipolar connector, a movable contact 65 is formed in a tip end portion of the predetermined contact piece 60, and a stationary contact 66 serving as a counter contact of the movable contact 65 is disposed in a rear end portion of the body 10. The soldering terminal 62 on the side of the predetermined contact piece 60, and a soldering terminal 67 which is disposed continuously from the stationary contact 66 protrude rearward and laterally from the lower side of the body 10.

In the predetermined contact piece 70 shown in FIG. 4, the front end portion is formed into a folded shape with respect to a mounting plate portion 71. A predetermined contact 73 is disposed on the predetermined contact piece 70, and a soldering terminal 72 is disposed continuously from the mounting plate portion 71. A projecting piece 74 which is bendingly formed on the mounting plate portion 71 can prevent the predetermined contact piece 70 from being broken by excessive deformation. The predetermined contact piece 70 is attached to the body 10 by inserting the mounting plate portion 71 into the mounting groove 19 of the body 10 from the rear side. Under this mounting state, as shown in FIG. 8, the predetermined contact 73 of the predetermined contact piece 70 protrudes into the insertion space 14. In the illustrated multipolar connector, a movable contact 75 is formed in a tip end portion of the predetermined contact piece 70, and a stationary contact 76 serving as a counter contact of the movable contact 75 is disposed on the body 10. The soldering terminal 72 on the side of the predetermined contact piece 70, and a soldering terminal 76 which is disposed continuously from the stationary contact 76 protrude laterally from the lower side of the body 10.

In the predetermined contact piece 80 shown in FIG. 5, the upper end portion is formed into a folded shape with respect to a mounting plate portion 81. A predetermined contact 83 is disposed on an arcuately curved portion of the predetermined contact piece 70, and a soldering terminal 82 is disposed continuously from the mounting plate portion 81. As shown in FIG. 10, the predetermined contact piece 80 is attached to the body 10 by inserting from the lower side into the mounting groove 25 that is passed through the vicinity of the front end portion of the body 10 in the thickness direction. Under this mounting state, as shown in FIG. 8, the predetermined contact 83 protrudes into the insertion space 14. The soldering terminal 82 on the side of the predetermined contact piece 80 protrudes laterally from the lower side of the body 10.

Figure 12:
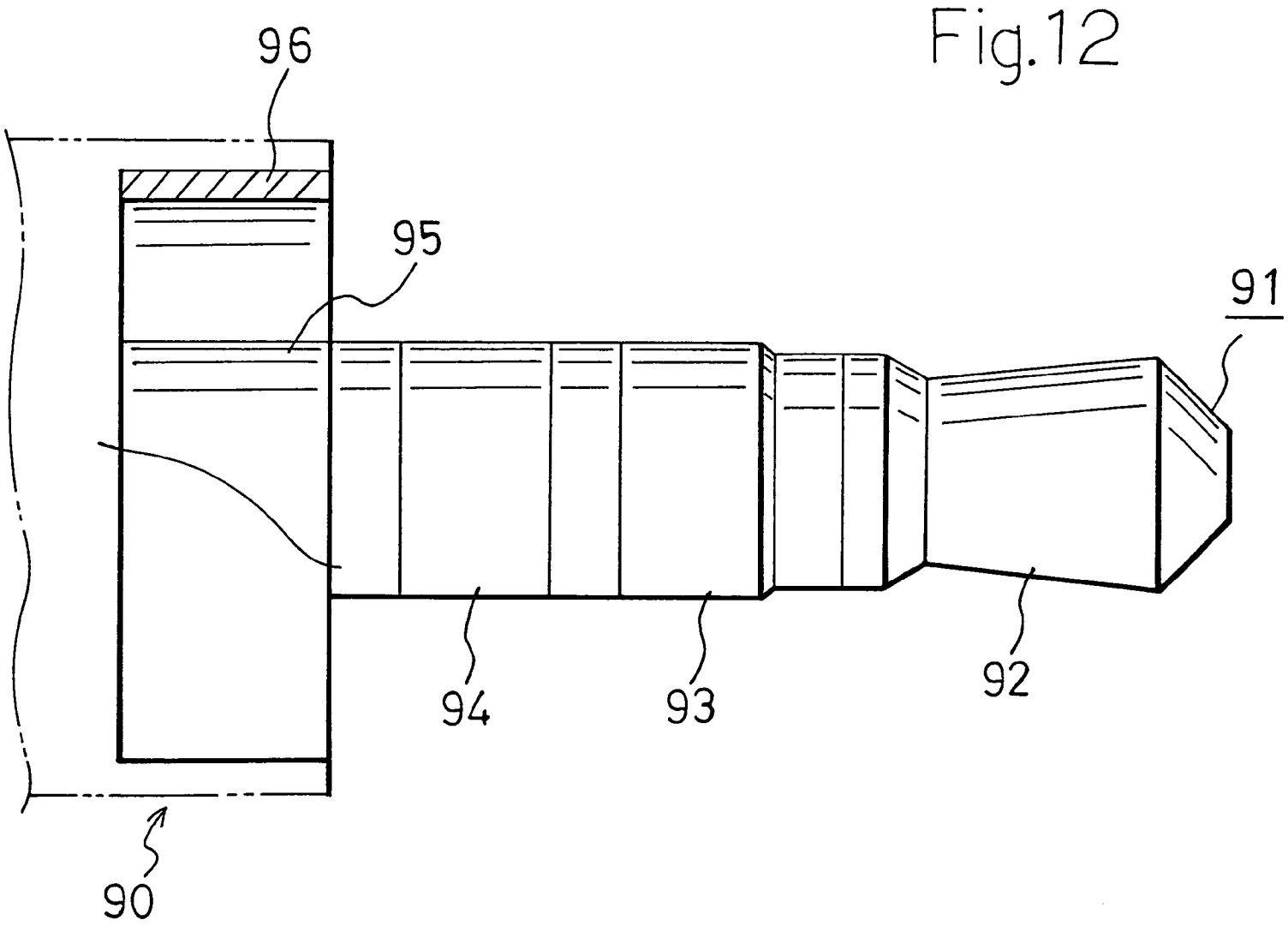
FIG. 12 is a side view of the counter connector.

In the counter connector 90, as shown in FIG. 12, the pole shaft 91 includes four or first to fourth center poles 92, 93, 94, and 95 which are arranged in the axial direction. The first center pole 92 corresponds to the one predetermined contact piece 60, the second center pole 93 to the other one predetermined contact piece 70, and the third center pole 94 to the further one predetermined contact piece 80. The fourth center pole 95 which is in the root of the pole shaft 91 corresponds to the second additional contact piece 50. The counter connector 90 has a cylindrical peripheral pole 96 which is concentric with the pole shaft 91 so as to be opposed to the root of the pole shaft 91. The peripheral pole 96 corresponds to the first additional contact piece 40.

In the above-described multipolar connector A, when the pole shaft 91 of the counter connector 90 is inserted into the insertion space 14 of the body 10 through the insertion/extraction port 37 (see FIG. 1 or 9) of the boss portion 30 as shown in FIG. 11, the first to third center poles 92, 93, and 94 of the pole shaft 91 are elastically in contact with the predetermined contacts 63, 73, and 83 of the three predetermined contact pieces 60, 70, and 80, respectively. Moreover, the first additional contact 42 of the first additional contact piece 40 is in contact with the peripheral pole 96 of the counter connector 90, and the second additional contact 58 (see FIG. 9) of the second additional contact piece 50 is elastically in contact with the fourth center pole 95 which is located in the root of the pole shaft 91 of the counter connector 90. As apparent from the above, in the illustrated multipolar connector A, three poles are ensured by the three predetermined contact pieces 60, 70, and 80 which are incorporated into the insertion space 14 of the body 10, one pole is ensured by the first additional contact piece 40 which is placed in the circle-cutaway portion 31 of the boss portion 30, and a further one pole is ensured by the second additional contact piece 50 which is placed in the inner peripheral side of the boss portion 30, with the result that five poles are ensured as a total.

The peripheral pole 96 of the counter connector 90 has a cylindrical shape. Even when the first additional contact piece 40 is formed into a long and narrow plate piece-like shape, therefore, the first additional contact 42 is always elastically in contact with the peripheral pole 96 as far as the pole shaft 91 of the counter connector 90 is inserted into the insertion space 14. Since the first additional contact 42 is formed in the tip end portion of the first additional contact piece 40 which is elastic and has a plate piece-like shape, the contact state between the first additional contact 42 and the peripheral pole 96 is stable and has high reliability.

In the embodiment, the five-pole connector in which the five poles are formed by the three predetermined contact pieces 60, 70, and 80, the single first additional contact piece 40, and the single second additional contact piece 50 has been described. When the first additional contact piece and the second additional contact piece are disposed at a number of two or more, it is possible to configure a multipolar connector having poles the number of which is larger than five. When two or more first additional contact pieces are to be disposed, a placement position for each of the first additional contact pieces is formed in plural positions in the circumferential direction of the boss portion. The placement positions may be formed by circle-cutaway portions which are formed by cutting away plural parts in the circumferential direction of the outer peripheral side of the boss portion. When two or more second additional contact pieces are to be disposed, a placement position for each of the second additional contact pieces is formed in plural positions in the circumferential direction of the inner peripheral side of the boss portion. In this case, it is preferable to form the second additional contact pieces into a plate piece-like shape which elongates in the longitudinal direction.

The entire disclosure of Japanese Patent Application No. 2000-034857 filed on Feb. 14, 2000 including specification, claims, drawings and summary are incorporated herein by reference in its entirety.

What is claimed is:

1. A multipolar electrical connector which uses a single-head plug as a counter connector, said single-head plug including: a pole shaft in which center poles are disposed in plural positions in an axial direction; and at least one peripheral pole which is opposed to an outside of a root of the said pole shaft with being separated from the root of said pole shaft by a distance, wherein said connector includes:

a body comprising an insertion space for said pole shaft;

a plurality of predetermined contact pieces attached to said body and comprising predetermined contacts which are to be in contact with said center poles other than said center pole in the root of said pole shaft that is inserted into said insertion space, respectively;

a cylindrical boss portion which protrudes from a front end of said body, and which forms an insertion/extraction port communicating with said insertion space;

a plate-like first additional contact piece which is placed in a placement position for said first additional contact piece, said placement position being formed in at least one position of an outer peripheral side of said boss portion;

a first additional contact which is disposed on said first additional contact piece, and which is to be in contact with said peripheral pole disposed in said counter connector;

a second additional contact piece which is placed in a placement position for said second additional contact piece, said placement position being formed in at least one position of an inner peripheral side of said boss portion; and a second additional contact which is disposed on said second additional contact piece, and which is to be in contact with said center pole in the root of said pole shaft of said counter connector.

2. A multipolar electrical connector according to claim 1, wherein said boss portion is formed into a cylindrical shape having a flat circle-cutaway portion which is formed by cutting away a part of an outer side of a peripheral wall, and said circle-cutaway portion functions as said placement position for said first additional contact piece.

3. A multipolar electrical connector according to claim 2, wherein said first additional contact piece has a first mounting plate portion which is fixed to said body, and forward elongates from said first mounting plate portion along an outer face of said circle-cutaway portion of said boss portion, to form a gap between said piece and the outer face of said circle-cutaway portion.

4. A multipolar electrical connector according to claim 3, wherein said first mounting plate portion is fixed to said body under a state where said portion is inserted into a mounting groove that rearward elongates from a front end face of said body.

5. A multipolar electrical connector according to claim 3, wherein said first additional contact outward protrudes from an inner side of a circle-cutaway space which is formed by said circle-cutaway portion of said boss portion.

6. A multipolar electrical connector according to claim 4, wherein said first additional contact outward protrudes from an inner side of a circle-cutaway space which is formed by said circle-cutaway portion of said boss portion.

7. A multipolar electrical connector according to claim 1, wherein a cutaway portion in which a narrow portion is located on a side of the front end of said boss portion and a wide portion continuous to said narrow portion is located on a side of a rear end of said boss portion is disposed in a position in a circumferential direction of said peripheral wall of said boss portion, said second additional contact piece which is formed into an annular shape is placed in the placement position for said second additional contact piece that is annularly formed on the inner periphery side of said boss portion, a gap is ensured between said second additional contact piece and the inner peripheral face of said boss portion, said second additional contact piece is split in a position in a circumferential direction of an annular portion and has a pair of outward tongue pieces which are disposed in end portions that are opposed to each other in the split portion, respectively, and said outward tongue pieces are inserted into said wide portion of said cutaway portion, and displaceable in separating and approaching directions in said wide portion in accordance with expanding and contracting deformations of said annular portion.

8. A multipolar electrical connector according to claim 7, wherein, when said annular portion is pressingly expanded by said pole shaft of said counter connector inserted into said annular portion, said pair of outward tongue pieces are displaced in the separating directions, whereby said pieces are respectively opposed in an axial direction of said boss portion to step portions in a boundary area between said narrow portion and said wide portion of said cutaway portion.

9. A multipolar electrical connector according to claim 1, wherein five poles are formed by said three predetermined contact pieces, said one first additional contact piece, and said one second additional contact piece.

10. A multipolar electrical connector according to claim 9, wherein, among said three predetermined contact pieces, two predetermined contact pieces are respectively placed on right and left sides of said insertion space, and a remaining one predetermined contact piece is placed in front of one of said two predetermined contact pieces.

11. A multipolar electrical connector according to claim 10, wherein said remaining one predetermined contact piece is formed into a folded shape with respect to a mounting plate portion that is disposed continuously from said predetermined contact piece, and said predetermined contact piece and said mounting plate portion are placed in a mounting groove that is passed through said body in a thickness direction.

* * * * *